US006046682A

United States Patent [19]

Zimmerman et al.

[11] Patent Number: 6,046,682

[45] **Date of Patent: *Apr. 4, 2000**

[54] ELECTRONIC PRICE LABEL INCLUDING NOISEMAKER AND METHOD OF LOCATING ELECTRONIC PRICE LABELS

[75] Inventors: Terry L. Zimmerman, Lawrenceville; Andrew J. Adamec, Duluth, both of Ga.

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/940,108

[22] Filed: Sep. 29, 1997

[51] Int. Cl.[7] ..... G08B 5/22

[52] U.S. Cl. ..... 340/825.49; 235/375; 235/385

[58] Field of Search ..... 340/825.49, 825.72, 340/825.73, 539, 573, 571, 825.35; 455/53.1, 100, 33.1, 67.1, 231, 344, 899; 371/5.1; 235/385, 375

[56] References Cited

U.S. PATENT DOCUMENTS

| | | | |
|---|---|---|---|
| 4,002,886 | 1/1977 | Sundelin | 235/61.7 R |
| 4,500,880 | 2/1985 | Gomersall et al. | 340/825.35 |
| 4,651,150 | 3/1987 | Katz et al. | 340/825.34 |
| 4,656,463 | 4/1987 | Anders et al. | 340/572 |
| 4,704,734 | 11/1987 | Menich et al. | 455/33 |
| 4,881,082 | 11/1989 | Graziano | 342/432 |
| 4,924,363 | 5/1990 | Kornelson | 362/125 |
| 4,962,466 | 10/1990 | Revesz et al. | 364/518 |
| 5,172,314 | 12/1992 | Poland et al. | 364/401 |
| 5,214,410 | 5/1993 | Verster | 340/572 |
| 5,241,467 | 8/1993 | Failing et al. | 364/401 |
| 5,245,534 | 9/1993 | Waterhouse et al. | 364/404 |
| 5,289,163 | 2/1994 | Perez et al. | 340/539 |
| 5,295,064 | 3/1994 | Malec et al. | 364/401 |
| 5,305,008 | 4/1994 | Cole et al. | 342/44 |
| 5,387,993 | 2/1995 | Heller et al. | 359/155 |
| 5,396,224 | 3/1995 | Dukes et al. | 340/825.49 |
| 5,406,271 | 4/1995 | Sonnendorfer et al. | 340/825.35 |
| 5,448,226 | 9/1995 | Failing, Jr. et al. | 340/825.35 |
| 5,450,070 | 9/1995 | Massar et al. | 340/825.35 |
| 5,505,473 | 4/1996 | Radcliffe | 280/79.2 |
| 5,528,232 | 6/1996 | Verma et al. | 340/825.54 |
| 5,539,393 | 7/1996 | Barfod | 340/825.52 |
| 5,548,282 | 8/1996 | Escritt et al. | 340/825.35 |
| 5,565,858 | 10/1996 | Guthrie | 340/825.35 |
| 5,604,923 | 2/1997 | Wilkus | 455/67.7 |
| 5,663,963 | 9/1997 | Goodwin, III | 371/5.1 |
| 5,686,891 | 11/1997 | Sacca et al. | 340/571 |

FOREIGN PATENT DOCUMENTS

| | | |
|---|---|---|
| 9064775 | 4/1991 | Australia . |
| 1233539 | 3/1988 | Canada . |
| 595549 | 5/1994 | European Pat. Off. . |

*Primary Examiner*—Howard L. Williams
*Assistant Examiner*—Jean B. Jeanglaude
*Attorney, Agent, or Firm*—Paul W. Martin; Peter H. Priest

[57] ABSTRACT

An electronic price label (EPL) including a noisemaker to assist in locating the EPL. Besides a noisemaker, the EPL includes processing circuitry which activates the noisemaker upon receipt of a command from a computer. A method for locating an EPL includes the steps of providing a noisemaker within the EPL, and transmitting a first signal to the EPL including a command to activate the noisemaker from a computer. The method may additionally include the steps of providing a plurality of receiving antennae, determining locations of the receiving antennae, transmitting a second message to the EPL by a computer coupled to the receiving antennae, listening for a third message from the EPL in response to the second message by the computer, determining signal strengths of the third message at each of the receiving antennae, and determining an estimate of the location of the EPL from the signal strengths by the computer.

17 Claims, 5 Drawing Sheets

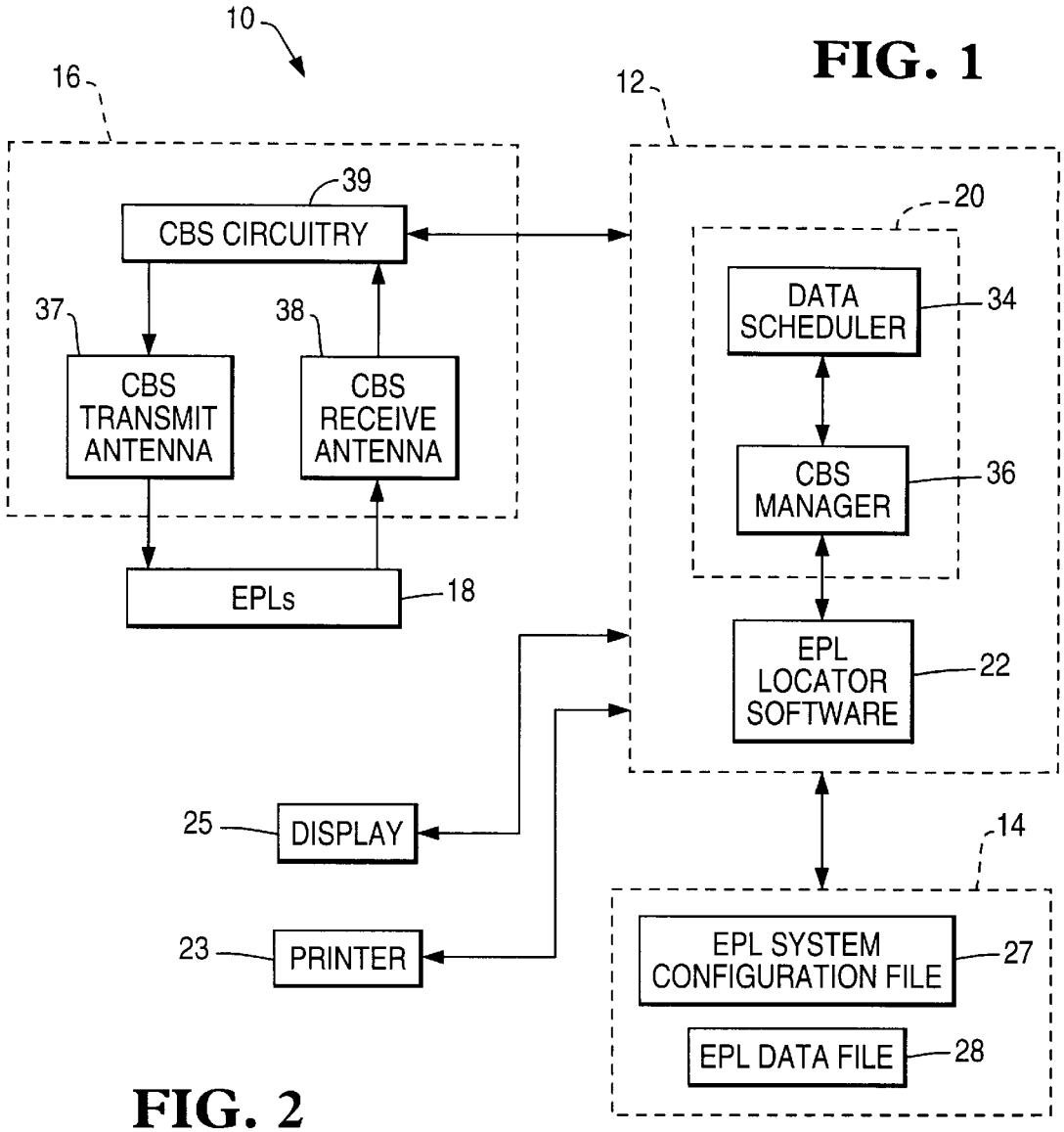
FIG. 1
FIG. 2
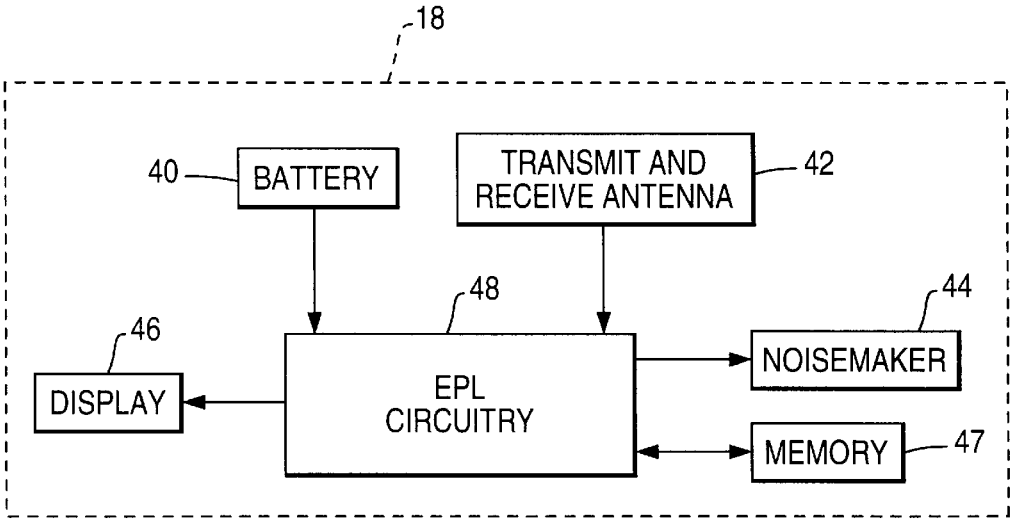

FIG. 7

EPL LOCATION REPORT
---

| | |
|---|---|
| PRIMARY LOCALES: | 4C<br>WINE SECTION FRONT LEFT |
| SECONDARY LOCALES: | 3B, 3C, 3D, 4B, 4D, 5B, 5C, OR 5D<br>BAKERY MID-FRONT<br>WINE SECTION FRONT RIGHT<br>WINE SECTION MID LEFT<br>WINE SECTION END CAP<br>BAKERY MIDDLE<br>BAKERY FRONT<br>WINE SECTION MID RIGHT<br>WINE SECTION END CAP RIGHT |

ELECTRONIC PRICE LABEL INCLUDING NOISEMAKER AND METHOD OF LOCATING ELECTRONIC PRICE LABELS

CROSS-REFERENCE TO RELATED APPLICATIONS

The present invention is related to the following commonly assigned U.S. applications:

"Method Of Locating Electronic Price Labels In Transaction Establishments", filed Oct. 5, 1995, invented by Goodwin, having a Ser. No. 08/539,450 having a CPA filed on Dec. 15, 1997, and abandoned on Jun. 1, 1998.

"Electronic Price Label System Including An Electronic Price Label For Attracting Customers", filed Jul. 29, 1997, invented by Zimmerman, and having a Ser. No. 08/902,024.

BACKGROUND OF THE INVENTION

The present invention relates to electronic price label (EPL) systems used in transaction establishments, and more specifically to an electronic price label including a noisemaker and a method of locating EPLs.

EPL systems typically include a plurality of EPLs for each merchandise item in a store. EPLs typically display the price of corresponding merchandise items on store shelves and are typically attached to a rail along the leading edge of the shelves. A store may contain thousands of EPLs to display the prices of the merchandise items. The EPLs are coupled to a central server from where information about the EPLs is typically maintained in an EPL data file. Price information displayed by the EPLs is obtained from the PLU file.

EPLs today may be wired or wireless. Wireless EPLs may employ infrared or radio frequency transmitters to transmit acknowledgment signals acknowledging receipt of messages and to relay acknowledgment signals from other EPLs to receiving devices coupled to a main EPL computer. An EPL only sends an acknowledgment if the message is addressed to it.

Over time, EPLs may be displaced from their mounting brackets. A customer or store employee may intentionally or unintentionally remove an EPL. In any case, the store must locate and reinstall the displaced EPLs, or determine that they are not in the store and replace them.

Therefore, it would be desirable to provide an electronic price label including a noisemaker and a method of locating and EPL using the noisemaker.

SUMMARY OF THE INVENTION

In accordance with the teachings of the present invention, an electronic price label including a noisemaker and a method of locating an EPL are provided.

The EPL includes a noisemaker to assist in locating the EPL and processing circuitry which activates the noisemaker upon receipt of a command from a computer.

An EPL system includes an EPL including a noisemaker, a computer, and a transmitter controlled by the computer for transmitting a first signal to the EPL including a command to activate the noisemaker. The EPL system may additionally include. a receiver for receiving a second signal from the EPL, signal strength and noise level determining circuitry coupled to the receiver and to the computer for measuring a signal strength and a noise level associated with the second signal, wherein the computer determines a direction to the EPL from the signal strength and noise level, and a display coupled to the computer for displaying the direction.

A method for locating an EPL includes the steps of providing a noisemaker within the EPL, and transmitting a first signal to the EPL including a command to activate the noisemaker from a computer. The method may additionally include the steps of providing a plurality of receiving antennae, determining locations of the receiving antennae, transmitting a second message to the EPL by a computer coupled to the receiving antennae, listening for a third message from the EPL in response to the second message by the computer, determining signal strengths of the third message at each of the receiving antennae, and determining an estimate of the location of the EPL from the signal strengths by the computer.

It is accordingly an object of the present invention to provide an electronic price label including a noisemaker.

It is another object of the present invention to provide an EPL with a noisemaker which when activated alerts store personnel to the location of the EPL if the EPL is ever removed or misplaced.

It is another object of the present invention to provide an EPL with a noisemaker which is activated by a command transmitted by a computer.

It is another object of the present invention to provide a method of locating an EPL which uses strength measurements of the EPL's transmitted signals and noise from a noisemaker within the EPL to located the EPL.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

FIG. 1 is a block diagram of an EPL system;

FIG. 2 is a block diagram of an EPL;

FIG. 7 is a sample report generated by the EPL locator software.

DETAILED DESCRIPTION OF THE PREFERRED EMBODIMENT

Figure 3:
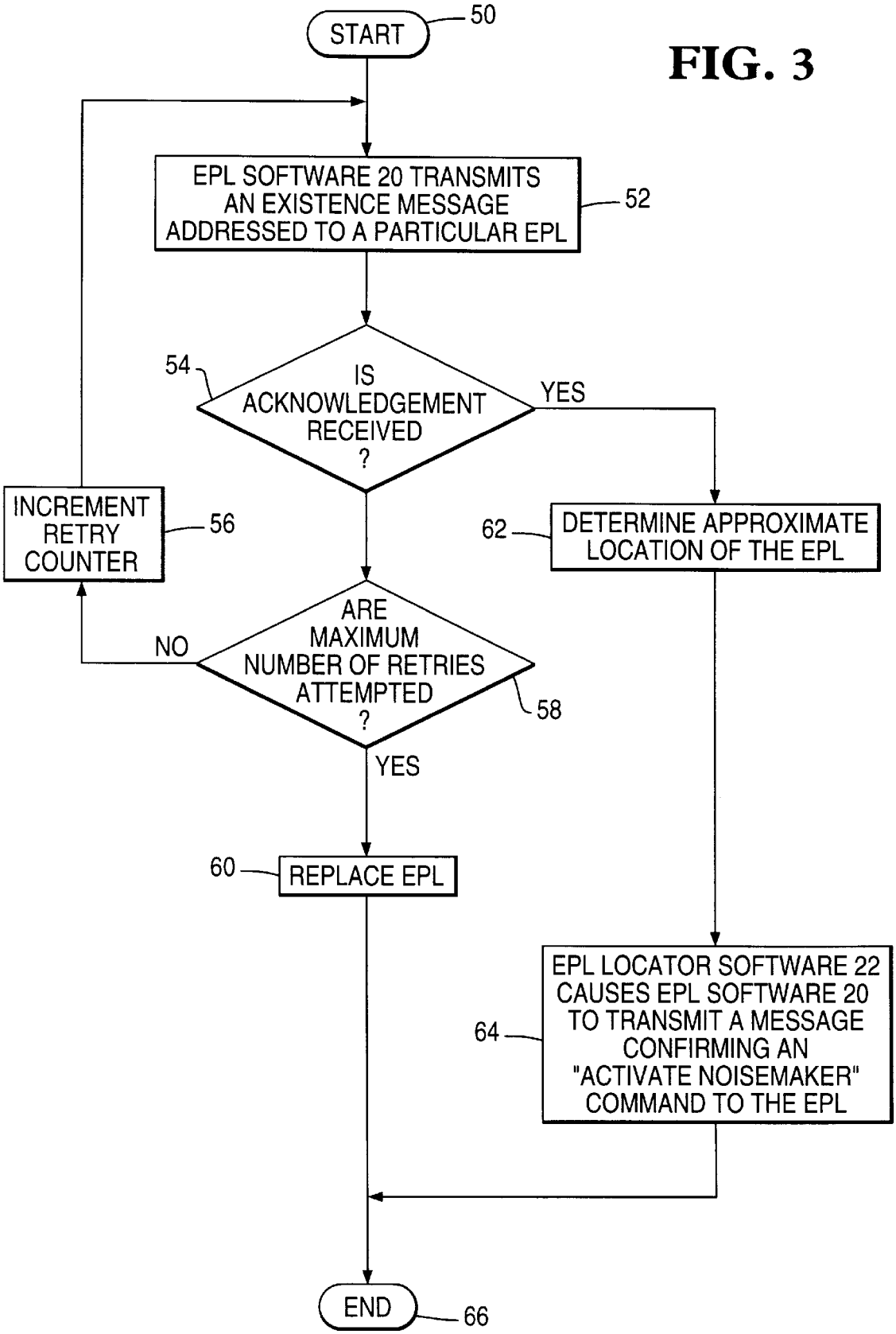
FIG. 3 is a flow diagram illustrating the operation of EPL control software in conjunction with the EPL locator software.

Referring now to FIG. 1, EPL system 10 includes computer 12, storage medium 14, communication base station (CBS) 16, electronic price labels (EPLs) 18.

Computer 12 executes EPL control software 20 and EPL locator software 22. EPL control software 20 records, schedules, and transmits all messages to EPLs through CBS 16, and receives and analyzes status messages from EPLs 18 through CBS 16. EPL control software 20 also maintains and uses EPL data file 28, which contains item information, EPL identification information, item price verifier information, and status information for each of EPLs 18.

EPL control software 20 primarily includes data scheduler 34 and CBS manager 36. Data scheduler 34 schedules EPL price change messages to be sent to EPLs 18 through CBS 16.

EPL locator software 22 automatically monitors EPL system 10 for received signal strength and determines the location of identified EPLs, which it stores in EPL system configuration file 27. EPL system configuration file 27 tells computer 12 how system 10 is configured, i.e., the addresses of EPL system components and their location within a transaction establishment relative to other components within system 10, and the location of different types of goods in system 10. EPL locator software 22 displays or prints location results on display 25 and printer 23.

Storage medium 14 is preferably a fixed disk drive. Storage medium 14 stores EPL system configuration file 27 and EPL data file 28.

CBS 16 preferably includes one transmit antenna 37 and from one to four receive antennas 38 for transmitting and receiving messages between CBS 16 and EPLs 18. CBS 16 includes CBS circuitry 39 which controls operation of CBS 16. EPL system 10 preferably includes a plurality of CBSs 16 connected together in series.

CBS manager 36 schedules transmission of price change messages to EPLs 18 and the reception of status messages from EPLs 18 for predetermined time slots.

Turning now to FIG. 2, EPLs 18 are illustrated.

EPLs 18 each include battery 40, transmit and receive antenna 42, noisemaker 44, display 46, memory 47, and EPL circuitry 48.

Battery 40 provides power to EPLs 18.

Transmit and receive antenna 42 receives price change and status messages from CBS 16. Transmit and receive antenna 42 transmits responses in the form of acknowledgments to price change and status messages to CBS 16.

Display 46 displays price and possibly additional information. Display 46 is preferably a liquid crystal display (LCD).

Memory 47 stores price verifier information, EPL type information, and may additionally store promotional information. Preferably, the price verifier information is a checksum of the displayed price.

EPL circuitry 48 controls the internal operation of EPLs 18. EPL circuitry 48 stores received messages from EPL computer 12 and transmits response messages to EPL computer 12. EPL circuitry 48 controls generation of noise by noisemaker 44 and the display of price and other information, including blinking.

Noisemaker 44 is preferably a self-contained, electronic beeper; however, more elaborate noisemaking systems are also envisioned, including systems which electronically produce speech. Noisemaker 44 makes a sound which is audible to a person who is not in the immediate vicinity of the lost EPL. The noise allows the searching person to "home in" on the location of the EPL.

Activation of noisemaker 44 is preferably controlled by storing an "activate noise" setting in EPL data file 28. Control settings for the noise, volume, period, and pitch may be added as well. EPL computer 12 reads EPL data file 28 and sends a message to a lost EPL 18 containing a command to activate noisemaker 44 in accordance with the settings in EPL data file 28.

Turning now to FIG. 3, the operation of EPL locator software 22 and EPL control software 20 in locating a lost EPL is explained in more detail, beginning with START 50.

In steps 52–60, EPL control software 20 determines whether a particular EPL 18 is out of the store or not functioning.

In step 52, EPL control software 20 transmits an existence message addressed to EPL 18.

In step 54, EPL control software 20 waits for an acknowledgment message from EPL 18.

If an acknowledgment message is not received, EPL control software 20 determines whether the maximum number of existence message transmission retries has been attempted in step 58.

If the maximum number of existence message retries has not been reached, EPL control software 20 increments a retry counter in step 56 and returns to step 52.

If the maximum number of existence message retries has been reached, EPL control software 20 stops transmitting existence messages and provides an indication to an operator to replace EPL 18 in step 60, since EPL 18 is either not operating or outside the range (i.e., outside of the transaction establishment) of CBS 16. The method ends in step 66.

Returning to step 54, if an acknowledgment is received from EPL 18, the method proceeds to step 62. In step 62, EPL locator software 22 obtains an approximate location of EPL 18 in accordance with the steps illustrated in FIG. 4.

In step 64, EPL locator software 22 causes EPL control software 20 to transmit a message addressed to EPL 18 and containing an "activate noisemaker" command and the method ends at step 66. After EPL 18 begins making noise, an operator can home in on the displaced EPL 18, starting from the primary estimate for the location determined in step 62.

Step 64 reflects the operation of EPL locator software 22 in conjunction with EPL control software 20. The present invention envisions that step 64 may be performed independently of steps 52–62. For example, in small stores, noise alone may be enough to locate an EPL 18. As a further example, in stores having large numbers of floor personnel, noise alone may be enough to locate an EPL 18.

Figure 4:
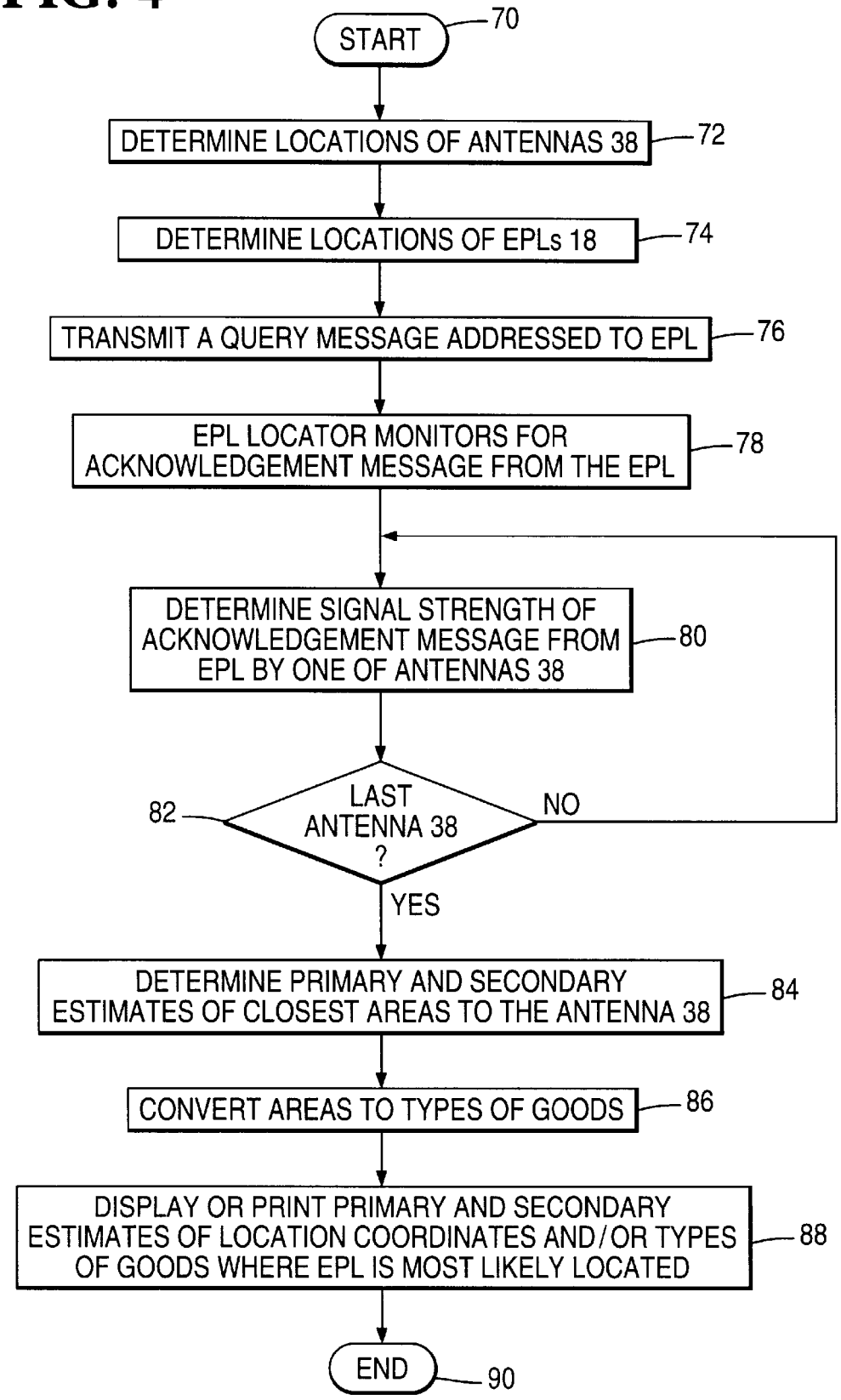
FIG. 4 is a flow diagram illustrating the method of locating the wireless EPLs by EPL locator software.

Turning now to FIG. 4, the operation of EPL locator software 22 represented by step 62 of FIG. 3 is explained in more detail, beginning with START 70.

In step 72, the locations of antennas 38 are determined. As an optional step, the locations of CBSs 16 may be plotted on the map of FIG. 5, but are included in configuration file 27 at installation time.

In step 74, the locations of EPLs 18 are determined. As an optional step, the locations of EPLs 18 may be plotted on the map of FIG. 5. This information is available in EPL configuration file 27, but is not reliable in a running system since changes occur often.

In step 76, EPL control software causes CBSs 16 to transmit a query message to a particular EPL, such as EPL 18.

In step 78, EPL locator software 22 listens for an acknowledgment message from the EPL.

In step 80, EPL locator software 22 determines the signal strengths of any acknowledgment message from the EPL 18 to one of antennas 38 within CBSs 16. If multiple antennas 38 receive the acknowledgment message, EPL locator software 22 uses basic radar tracking methods to determine the location of the EPL.

In step 82, EPL locator software 22 determines whether signal strength information for the last of antennas 38 has been determined. If all CBSs 16 have been polled for signal strength information about their antennas 38, the method continues to step 84. If a CBS has not been polled, the method returns to step 80.

Figure 5:
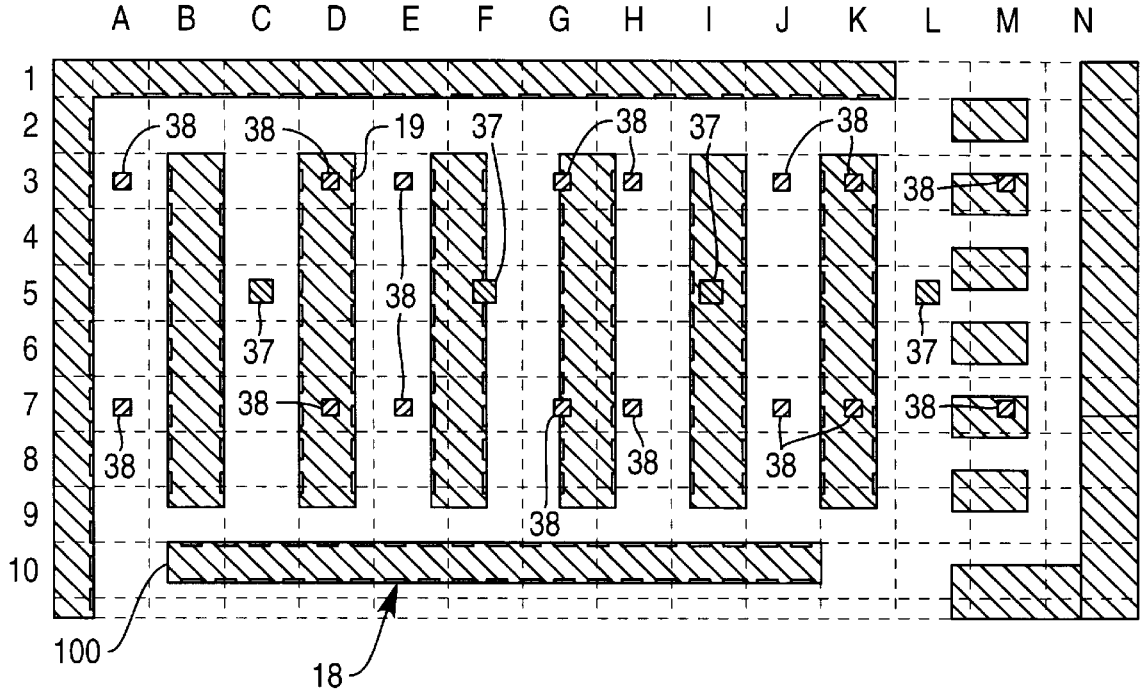
FIG. 5 is a first example of a map of a transaction establishment.

In step 84, EPL locator software 22 determines the primary and secondary estimates of fixes to the antennas 38 on the map in FIG. 5.

In step 86, EPL locator software 22 optionally converts the fixes to types of goods using information in EPL configuration file 27.

In step 88, EPL locator software 22 displays or prints primary and secondary estimates of the location coordinates and/or types of goods where the desired EPL is most likely located. A sample report is shown in FIG. 7.

If store personnel determine that the location of the EPL does not correspond to its location in EPL configuration file 27 (e.g., because a child has removed it and placed it somewhere else), they can place the EPL in its proper location.

In step 90, the method ends.

Turning now to FIG. 5, a map of a transaction establishment illustrates the location of shelves 100 and EPLs 18.

The locations of EPLs 18 are referenced to a two-dimensional coordinate system in which rows are identified by numerals and columns are identified by letters.

In this example, EPL 19 is sought after and is located at position 3D. Receive antennas 38 are located at 3A, 7A, 3D, 7D, 3E, 7E, 3G, 7G, 3H, 7H, 3J, 7J, 3K, 7K, 3M, and 7M. Transmit antennas 37 are located at 5C, 5F, 5I, and 5L.

If from the information in EPL configuration file 27 it is known that position 3D is 'in back of the pop aisle', then it is also known that EPL 19 is 'in back of the pop aisle'.

In this example, only one receive antenna 38 at position 3D hears the acknowledgment of EPL 19. The primary fix for EPL 19 is position 3D. A less accurate fix for EPL 19 is any one of positions 2C, 2D, 2E, 3C, 3E, 4C, 4D, or 4E that surround the primary fix.

Figure 6:
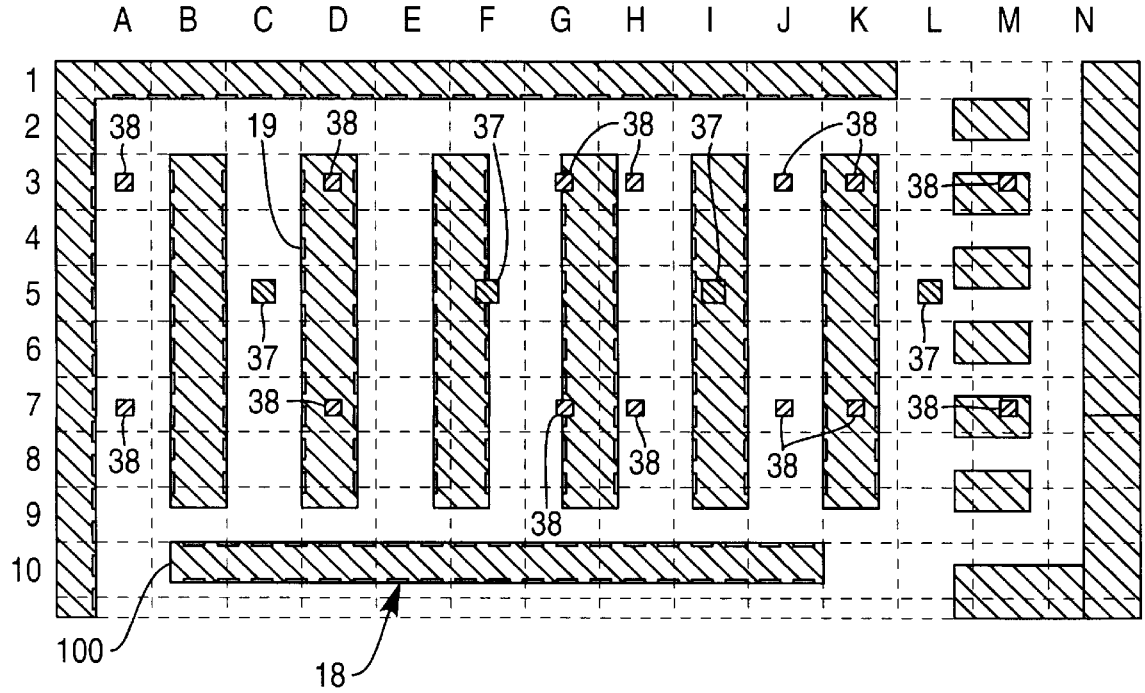
FIG. 6 is a second example of a map of a transaction establishment.

Turning now to FIG. 6, three receive antennae 38 at positions 3D, 3A, and 7D hear the acknowledgment of EPL 19. Antenna 3D reports a relative signal strength of "60", and antennae 3A and 7D report relative signal strengths of "30". The primary fix for EPL 19 is position 4C. A secondary fix for EPL 18 is any one of positions 3B, 3C, 3D, 4B, 4D, 5B, 5C, or 5D that surround the primary fix. Here, EPL 19 is actually located in one of the secondary fixes, 4D.

Although the present invention has been described with particular reference to certain preferred embodiments thereof, variations and modifications of the present invention can be effected within the spirit and scope of the following claims.

What is claimed is:

1. An electronic price label (EPL) system comprising:

an EPL including a noisemaker, an EPL transmitter and an EPL receiver;

a computer;

a transmitter and a plurality of receivers, both the transmitter and the plurality of receivers controlled by the computer, the transmitter which transmits a signal and a message to the EPL, the signal including a command to activate the noisemaker, and the message including a price change command to change the displayed price for the item; and wherein said EPL responds to both the signal and the message with an acknowledgement signal.

2. The electronic price label (EPL) system of claim 1 wherein:

the noisemaker makes an audible sound.

3. The electronic price label (EPL) system of claim 1 wherein:

the transmitter transmits an existence message to the EPL to determine if the EPL is operating and within a predetermined range of the transmitter.

4. The electronic price label (EPL) system of claim 1 wherein:

the command to activate the noisemaker includes a volume setting of the noisemaker.

5. The EPL system as recited in claim 1, further comprising:

the plurality of receivers receiving the acknowledgement signal from the EPL;

signal strength and noise level determining circuitry coupled to the plurality of receivers and to the computer for measuring a signal strength and a noise level associated with the acknowledgement signal;

wherein the computer determines a direction to the EPL from the signal strength and the noise level; and a display coupled to the computer for displaying the direction.

6. The electronic price label (EPL) system of claim 5 wherein:

the computer determines a location of the EPL from the signal strength and the noise level.

7. The electronic price label (EPL) system of claim 5 wherein:

the direction to the EPL is established relative to a location of different types of goods.

8. The electronic price label (EPL) system of claim 5 wherein:

the computer determines a primary location and a secondary location of the EPL from the signal strength and the noise level.

9. An electronic price label (EPL) system comprising:

a plurality of individually addressable EPLs, each of the plurality of addressable EPLs including a noisemaker;

a computer; and a transmitter controlled by the computer which transmits a signal and a message addressed to one of the plurality of EPLs, the signal including a command to activate the noisemaker of the EPL and the message including a command to change a displayed price for an item.

10. The electronic price label (EPL) system of claim 9 further comprising:

a plurality of receivers which receive a response signal from the EPL;

signal strength and noise level determining circuitry coupled to the plurality of receivers and to the computer which measure a signal strength and a noise level associated with the response signal;

wherein the computer determines a direction to the EPL from the signal strength and the noise level; and a display coupled to the computer for displaying the direction.

11. The electronic price label (EPL) system of claim 10 wherein:

the computer determines a location of the EPL from the signal strength and the noise level.

12. The electronic price label (EPL) system of claim 10 wherein:

the direction to the EPL is established relative to a location of different types of goods.

13. A method of locating a first electronic price label (EPL) in a transaction establishment which includes a further plurality of EPLs, the method comprising the steps of:

providing a noisemaker within the first EPL;

transmitting a price change message addressed to the first EPL from a computer;

transmitting a first signal addressed to the first EPL from the computer, said first signal including a command to activate the noisemaker;

receiving the first signal by both the first EPL and the plurality of EPLs; and activating the noisemaker of the first EPL.

14. The method of claim 13, further comprising the step of:

transmitting an existence message to the first EPL from the computer to determine if the EPL is operating and within a predetermined range of the transmitter.

15. A method of locating an electronic price label (EPL) which is part of an EPL system in a transaction establishment, the system including a further plurality of EPLs and the EPL including a noisemaker, an EPL transmitter and an EPL receiver, the method comprising the steps of:

transmitting a message to the EPL from a computer including a transmitter and a plurality of receiving antennae, the plurality of receiving antennae located at a plurality of known locations, the message including a command to change the price displayed for an item;

transmitting a signal to the EPL from the computer, the signal including a command to activate the noisemaker;

receiving an acknowledgement message from the EPL by the plurality of receiving antennae;

determining signal strengths of the acknowledgement message at each of the plurality of receiving antennae; and determining an estimate of the location of the EPL from the signal strengths.

16. The method of claim 15 further comprising the step of:

determining a location of goods located in the proximity of the EPL.

17. The method of claim 16 further comprising the step of:

generating a report listing the goods at the location of the EPL.

* * * * *